US011588251B1

(12) United States Patent
Markey

(10) Patent No.: US 11,588,251 B1
(45) Date of Patent: Feb. 21, 2023

(54) ANTENNA FEED FOR A STACKABLE ANTENNA, AND ASSOCIATED METHODS

(71) Applicant: FIRST RF Corporation, Boulder, CO (US)

(72) Inventor: Michael Robert Markey, Broomfield, CO (US)

(73) Assignee: FIRST RF Corporation, Boulder, CO (US)

( * ) Notice: Subject to any disclaimer, the term of this patent is extended or adjusted under 35 U.S.C. 154(b) by 93 days.

(21) Appl. No.: 17/204,444

(22) Filed: Mar. 17, 2021

(51) Int. Cl.

| | |
|---|---|
| ***H01Q 21/00*** | (2006.01) |
| ***H01Q 9/28*** | (2006.01) |
| ***H01Q 9/30*** | (2006.01) |
| ***H01Q 15/24*** | (2006.01) |
| ***H01Q 1/42*** | (2006.01) |
| ***H01Q 1/52*** | (2006.01) |
| ***H01Q 21/10*** | (2006.01) |

(52) U.S. Cl.
CPC ..... *H01Q 21/0006* (2013.01); *H01Q 1/42* (2013.01); *H01Q 1/52* (2013.01); *H01Q 9/28* (2013.01); *H01Q 9/30* (2013.01); *H01Q 15/246* (2013.01); *H01Q 21/10* (2013.01)

(58) Field of Classification Search
CPC .. H01Q 1/42; H01Q 9/28; H01Q 9/30; H01Q 15/12; H01Q 15/246; H01Q 21/0006; H01Q 21/08; H01Q 21/10
See application file for complete search history.

(56) References Cited

U.S. PATENT DOCUMENTS

| | | | | |
|---|---|---|---|---|
| 3,829,863 | A | 8/1974 | Lipsky | |
| 5,534,880 | A | 7/1996 | Button et al. | |
| 5,767,814 | A * | 6/1998 | Conroy | H01Q 3/40 343/893 |

(Continued)

OTHER PUBLICATIONS

Dastranj, A. & Abbasi-Arand, B. "High-Performance 45○ Slant-Polarized Omnidirectional Antenna for 2-66-GHz UWB Applications" IEEE Transactions Antennas and Propagation, vol. 64, No. 2, Feb. 2016.

(Continued)

*Primary Examiner* — Robert Karacsony
(74) *Attorney, Agent, or Firm* — Lathrop GPM LLP

(57) ABSTRACT

An antenna feed for a stackable antenna system includes a polarization converter that continuously surrounds an omnidirectional antenna. Electromagnetic radiation emitted by the omnidirectional antenna and having an initial polarization passes through the first polarization converter, which converts the initial polarization into a non-vertical linear polarization. A feedline located outside of the first polarization converter forms a helix that wraps around the first polarization converter such that it runs perpendicularly to the non-vertical linear polarization. When the width of the feedline is sufficiently small, electrons in metal of the feedline will not be excited by the radiation, and the radiation will transmit through the feedline with minimal impact on the omnidirectional antenna's gain profile. The feedline may be used to feed a second antenna located vertically above the omnidirectional antenna. When the first polarization converter outputs horizontally polarized radiation, the feedline may form a straight vertical line.

28 Claims, 11 Drawing Sheets

(56) References Cited

U.S. PATENT DOCUMENTS

| | | | |
|---|---|---|---|
| 8,228,257 | B2 | 7/2012 | Lalezari |
| 8,339,324 | B1 | 12/2012 | Dufilie |

OTHER PUBLICATIONS

Ding, C. & Luk, K. "Wideband Omnidirectional Circularly Polarized Antenna for Millimeter-Wave Applications Using Printed Artificial Anisotropic Polarizer," 2019 IEEE pp. 1103-1104.
Rohde & Schwarz HF—VHF/UHF—SHF Antennas | Catalog 2020/2021, 2 pages.
Yahyaoui, A. et al. "Design of All-Dielectric Half-wave and Quarter-wave Plates Microwave Metasurfaces Based on Elliptic Dielectric Resonators" Applied Computational Electromagnetics Society Journal, vol. 32, No. 3, Mar. 2017, pp. 229-236.
Ye, Y. He, S. "90 degree polarization rotator using a bilayered chiral metamaterial with giant optical activity" Jan. 17, 2010, 16 pages.
Zhao, J. et al. "A Wide-angle Multi-Octave Broadband Waveplate Based on Field Transformation Approach", Scientific Reports, Published: Dec. 7, 2015, pp. 1-9.

* cited by examiner

ANTENNA FEED FOR A STACKABLE ANTENNA, AND ASSOCIATED METHODS

BACKGROUND

Multiple antennas may be stacked vertically to form a steerable phased array, a multiple phase-center array, or an antenna system that operates over a wider bandwidth than any of the individual antennas. Some, if not all, of the antennas may be omnidirectional, in which case vertically stacking places each antenna in the nulls of the overlying and underlying antennas. With this arrangement, the multiple antennas may be placed vertically proximate to each other while still minimizing cross coupling and interference.

SUMMARY

For multiple antennas arranged in a stack, feedlines must be routed vertically past the lowest antenna of the stack. When this lowest antenna is omnidirectional, the feedlines will pass through electromagnetic fields emitted by the lowest antenna. Feedlines typically contain metal (e.g., a coaxial cable with a metallic inner conductor and a metallic ground shield), and electrons in the metal may be excited by the oscillating electric-field component of the electromagnetic fields. The metal will reflect the emitted electromagnetic fields in various directions, thereby decreasing the lowest antenna's gain and distorting its gain profile. Furthermore, metal in the near-field of the lowest antenna will electromagnetically couple with this lowest antenna, changing its electrical impedance. These problems with routing metal-based feedlines occur for every omnidirectional antenna in the stack except for the topmost antenna.

The present embodiments feature an antenna feed that advantageously routes one or more metal-based feedlines past an omnidirectional antenna with minimal impact on the antenna's gain profile. The antenna feed includes a first polarization converter that continuously surrounds the omnidirectional antenna in the horizontal plane. Electromagnetic radiation emitted by the omnidirectional antenna and having an initial polarization passes through the first polarization converter, which converts the initial polarization into a non-vertical linear polarization characterized by a polarization angle $\alpha$ relative to the vertical direction. For example, the omnidirectional antenna may be a bicone, monocone, or discone antenna that emits radiation having an initial polarization that is linear and vertical (i.e., $\alpha=0°$). In this case, the first polarization converter may rotate the initial polarization away from vertical such that a is non-zero. Alternatively, the initial polarization may be circular, in which case the first polarization converter may transform the circular polarization into the non-vertical linear polarization.

The antenna feed also includes a feedline located outside of the first polarization converter. In some embodiments, the feedline forms a helix that encircles the first polarization converter and is coaxial with the omnidirectional antenna. The helix has a helical angle equal to $|\alpha|$, and a helicity determined by the sign of $\alpha$. With this geometry, the helix always runs perpendicularly to the non-vertical linear polarization. When the width of the feedline is small (i.e., typically less than one-half of the wavelength of the radiation), electrons in the metal of the feedline will not be excited by the electromagnetic radiation, and the radiation will transmit through the feedline with minimal impact on the omnidirectional antenna's gain profile. In other embodiments, the first polarization converter outputs horizontally polarized radiation, in which case the feedline may form a straight vertical line that minimizes cable length.

The feedline may conduct an electrical signal upward to feed a second antenna located vertically above the omnidirectional directional. Alternatively or additionally, the feedline may be used to receive an electrical signal from the second antenna. In some embodiments, the antenna feed contains several feedlines, all similarly shaped, to feed several antennas located vertically above the omnidirectional antenna. Several of the present embodiments may be used with a single stackable antenna system to route electrical signals vertically past any omnidirectional antenna in the stack, not just the lowest antenna.

Instead of the second antenna, the present embodiments may be used to connect one or more wires to any one or more electrical devices located above the omnidirectional antenna. Examples of such electrical devices include cameras, infrared sensors, radar equipment, solar panels, GPS equipment, audio devices, lights, and so on. Examples of the one or more wires include transmission lines (e.g., coaxial cables, twisted-pair wires, etc.), power cables, multi-conductor cables, metallized fiber-optic cables, and combinations thereof. The present embodiments may also be used to connect one or more non-electrical feeds to one or more non-electrical devices located above the omnidirectional antenna. For example, the non-electrical feeds may include metal pipes or conduits used to transport liquids or gases. Alternatively, the non-electrical feeds may include metal cables or wire ropes (e.g., Bowden cables). As such, these non-electrical feeds may be used for hydraulic, pneumatic, and mechanical control.

In some embodiments, the antenna feed includes a second polarization converter that continuously surrounds the first polarization converter in the horizontal plane. In this case, the feedline may be located between a radial gap formed between the first and second polarization converters. The second polarization converter may be used to convert the non-vertical linear polarization into a final polarization. For example, the final polarization may be linear and vertical. Alternatively, the final polarization may be linear and non-vertical, circular, or elliptical. In some embodiments, the second polarization converter is omitted, in which case the final polarization is the same as the non-vertical linear polarization.

In embodiments, an antenna feed includes a first polarization converter continuously surrounding an omnidirectional antenna that emits, toward the first polarization converter, electromagnetic fields having an initial polarization. The first polarization converter is oriented to convert the initial polarization into a linear polarization. The antenna feed also includes a feedline located outside of the first polarization converter, with respect to the omnidirectional antenna, and oriented perpendicularly to the linear polarization. In some of these embodiments, the antenna feed also includes a second polarization converter continuously surrounding the first polarization converter and oriented to convert the linear polarization into a final polarization. In these embodiments, the feedline is located between the first and second polarization converters.

In embodiments, an antenna feeding method includes emitting, with an omnidirectional antenna, electromagnetic fields having an initial polarization. The antenna feeding method also includes converting, using a first polarization converter continuously surrounding the omnidirectional antenna, the initial polarization into a linear polarization. The antenna feeding method also includes feeding a second antenna located above the omnidirectional antenna with a feedline located outside of the first polarization converter, with respect to the omnidirectional antenna, and oriented perpendicularly to the linear polarization.

DETAILED DESCRIPTION OF THE EMBODIMENTS

Figure 1:
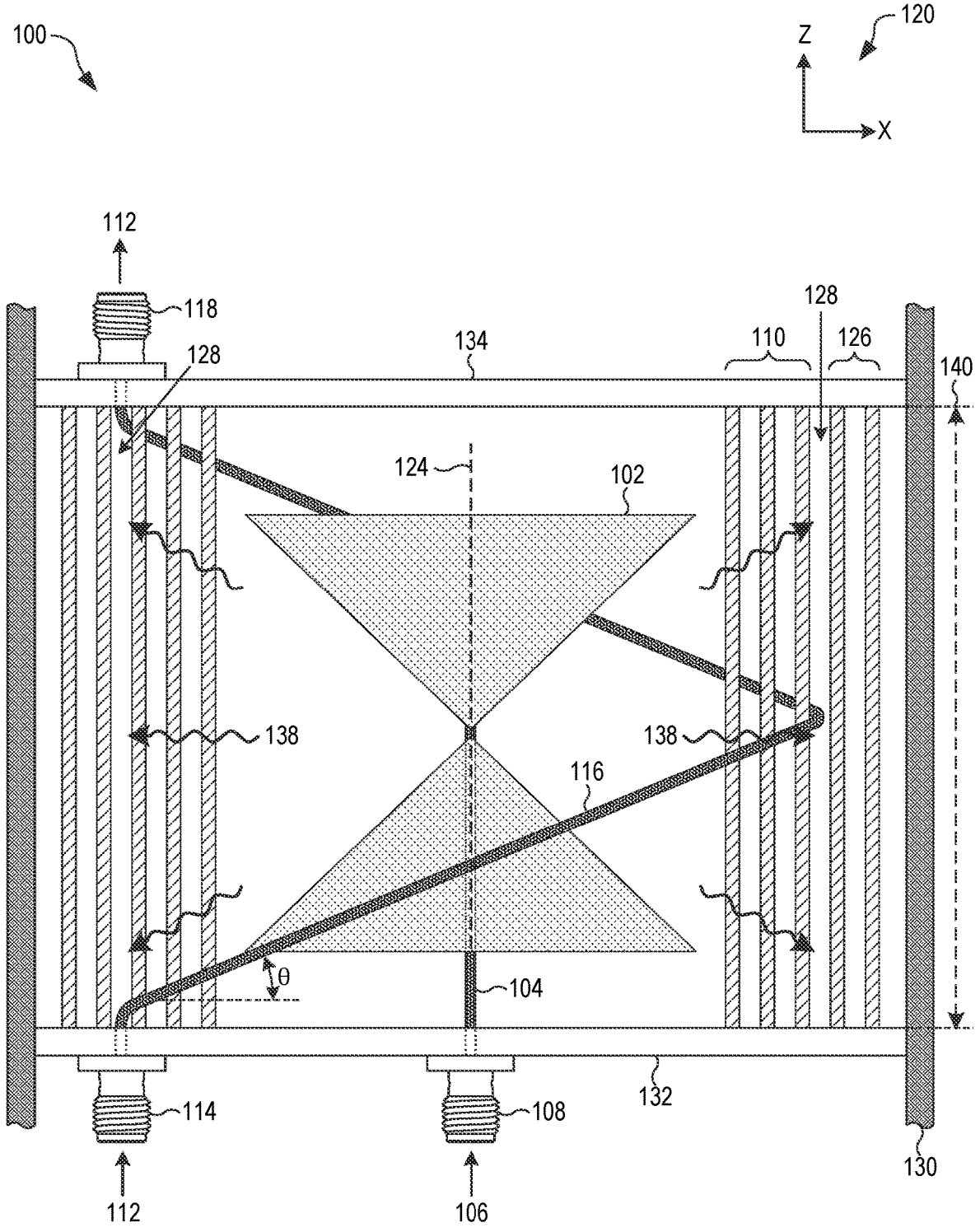
FIG. 1 shows a side view of an antenna feed conducting an electrical signal around an omnidirectional antenna, in embodiments.
Figure 2:
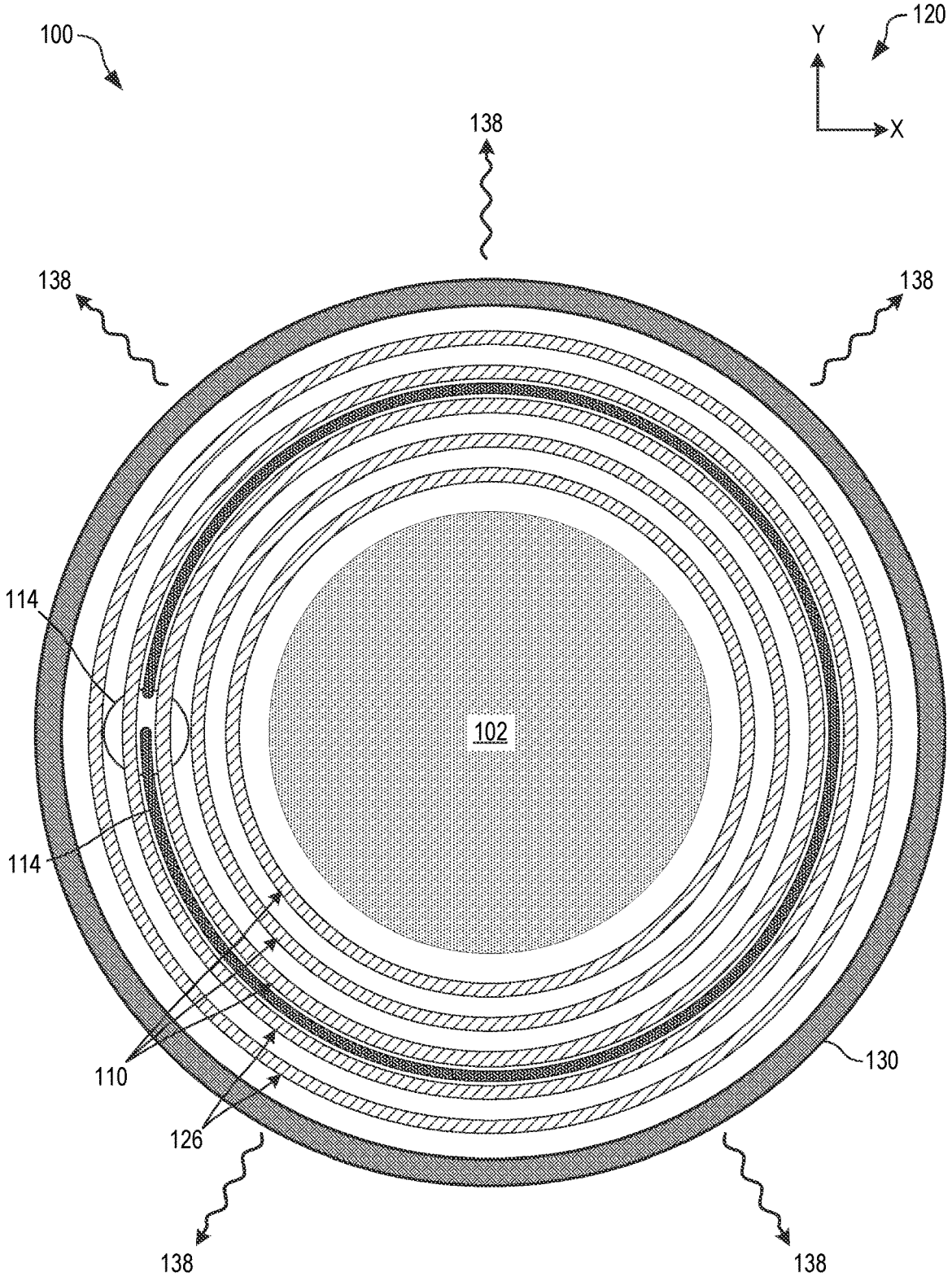
FIG. 2 shows a top view of the antenna feed and omnidirectional antenna of FIG. 1, in embodiments.

FIG. 1 shows a side view of an antenna feed 100 conducting an electrical signal 112 around an omnidirectional antenna 102. FIG. 2 shows a top view of the antenna feed 100 and omnidirectional antenna 102 of FIG. 1. The antenna feed 100 includes a cable 116 that conducts the electrical signal 112 upward across a vertical gap 140 while minimizing attenuation and distortion of electromagnetic fields 138 radiated by the antenna 102. The cable 116 is formed at least partially from metal, such as the shielding of a coaxial cable, and connects to an antenna (see FIG. 4) or other type of electronic device located vertically above the antenna 102 (i.e., in the z direction, see the right-handed coordinate system 120). The cable 116 may additionally or alternatively conduct an electrical signal downward across the vertical gap 140.

The antenna feed 100 also includes a first polarization converter 110 that continuously surrounds the omnidirectional antenna 102, and a second polarization converter 126 that continuously surrounds the first polarization converter 110. As shown in FIGS. 1 and 2, the cable 116 is shaped as a helix that winds around the omnidirectional antenna 102 with a helical angle θ. The helix is coaxial with the antenna 102 and runs through a radial gap 128 between the polarization converters 110 and 126. In FIGS. 1 and 2, the first polarization converter 110 is shown as having three separate layers, each shaped as a cylindrical shell that is coaxial with the antenna 102. Similarly, the second polarization converter 126 is shown as having two separate layers, each of which is also shaped as a cylindrical shell that is coaxial with the antenna 102. In this case, the radial gap 128 is also cylindrical and coaxial with the antenna 102. However, one or both of the polarization converters 110 and 126 may have a different non-circular cross-sectional shape in the horizontal plane (e.g., square tube, rectangular tube, hexagonal tube, octagonal tube, etc.) without departing from the scope hereof. More details about the polarization converters 110 and 126 are presented below. For clarity in FIG. 1, only cross-sectional views of the polarization converters 110 and 126 are shown.

While FIGS. 1 and 2 show the cable 116 forming a right-handed helix, the cable 116 may alternatively form a left-handed helix. While FIGS. 1 and 2 show the cable 116 forming one full loop in the x-y plane, the cable 116 may alternatively make a different number of loops, either integer or fractional. This includes less than one full loop, i.e., a fraction of one full loop. While FIGS. 1 and 2 show the cable 116 forming a circular helix, the cable 116 may alternatively form a square helix, a rectangular helix, or another type of helix. The cable 116 may be any kind of electrical transmission line (e.g., coaxial cable, twisted pair, hollow waveguide, etc.), electrical cable, one or more electrical wires, a metalized optical fiber or optical-fiber bundle, a fiber-optic cable with a metal jacket. Where the cable 116 connects to an antenna (e.g., see FIG. 6), the cable 116 may serve as at least part of a feedline of the antenna. In some embodiments, the cable 116 is replaced with a metal conduit, such as a metal pipe (e.g., copper tubing). Alternatively, the cable 116 may be a mechanical cable or wire rope. The cable 116 may be any other helical-shaped component, at least partially made of metal, without departing from the scope hereof.

The antenna 102 is "omnidirectional" in that it can radiate over all azimuthal directions in the x-y plane. For example, the antenna 102 is shown in FIG. 1 as a biconical antenna that radiates over all azimuthal directions simultaneously. The antenna 102 is fed with a drive signal 106 that is conducted along a feedline 104 running coaxially with an antenna axis 124 of the antenna 102. The antenna axis 124 is parallel to the z axis. The antenna 102 emits radiation 138 that is linearly polarized along the antenna axis 124, and is therefore vertically polarized. The antenna 102 may alternatively be a monocone antenna, a discone antenna, or another type of broadband, traveling wave structure that radiates omnidirectionally. The antenna 102 may alternatively be a narrow-band resonant structure that radiates omnidirectionally, such as a monopole antenna, vertically oriented dipole antenna, horizontally oriented loop antenna, or normal-mode helical antenna. The antenna 102 may alternatively be an array of radiating antenna elements, and therefore the antenna 102 is not limited to only a single radiator. Without departing from the scope hereof, the antenna 102 may have a radiation pattern that includes a finite number of azimuthal nulls (i.e., azimuthal angles at which the gain of the antenna 102 is zero).

In other embodiments, the antenna 102 is "omnidirectional" in that it radiates over all azimuthal directions, but not simultaneously. For example, the antenna 102 may mechanically rotate about the antenna axis 124 to azimuthally scan a beam. Alternatively, the antenna 102 may be a phased array that is electronically steerable to transmit a beam (e.g., a main lobe) at any azimuthal direction.

The vertically polarized radiation 138 propagates through the first polarization converter 110, which rotates the linear polarization to a direction other than vertical. Specifically, radiation 138 exiting the first polarization converter 110 propagating through the radial gap 128 with a linear polarization oriented at a non-zero acute angle α relative to the z direction. For clarity, the radiation 138 in the radial gap 128 is referred to as α-polarized radiation 138.

Figure 3:
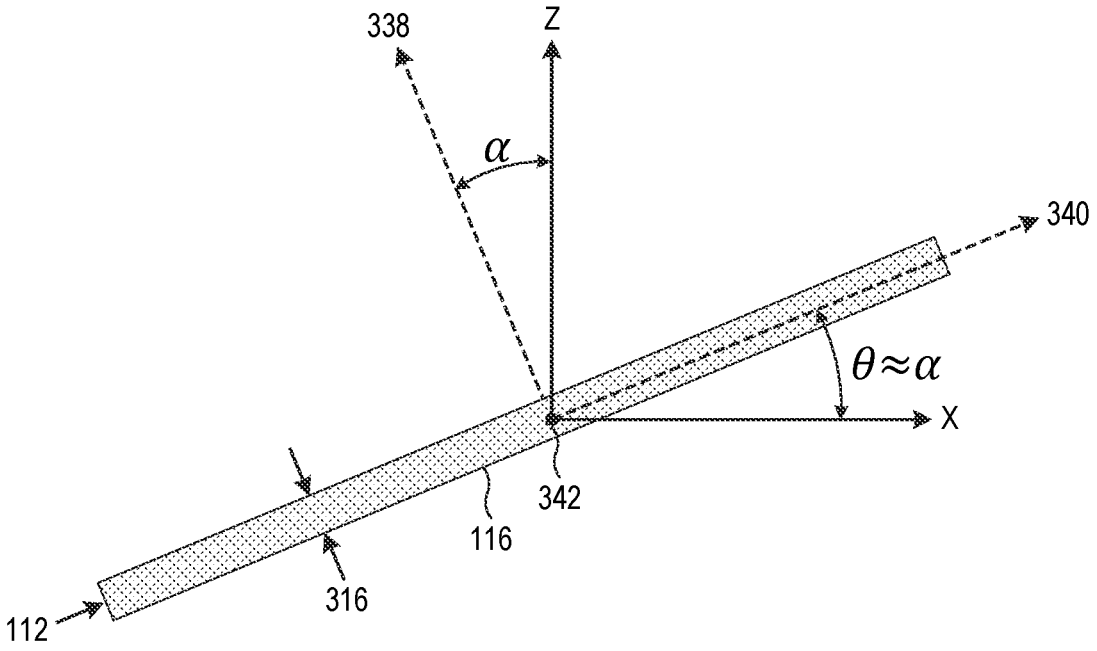
FIG. 3 is a side view of a portion of a cable within a radial gap formed by the antenna feed of FIGS. 1 and 2, in an embodiment.

FIG. 3 is a side view of a portion of the cable 116 within the radial gap 128. At a point 342, the cable 116 has a tangent vector 340 that points along the arc length of the helix, and therefore forms the helical angle θ with respect to the horizontal x-y plane. The α-polarized radiation 138 propagates along the direction normal to the x-z plane (i.e., into or out of the plane of the figure), and has an electric-field vector 338 oriented at the angle α relative to the z direction. As the helical angle θ approaches α, the electric-field vector 338 becomes increasingly perpendicular to the tangent vector 340, and the α-polarized radiation 138 will have a small, if any, component lying parallel to the arc length of the helix. The cable 116 has a width 316 measured perpendicularly to the tangent vector 340. Assuming the width 316 is less than one-half of the wavelength of the radiation 138, then the α-polarized radiation 138 will not excite electrons in the metal of the cable 116. In this case, the α-polarized radiation 138 will not reflect off of the cable 116, instead propagating through the cable 116 with minimal loss and distortion. This argument is true for all other points along the cable 316 within the radial gap 128. Therefore, the α-polarized radiation 138 will propagate through the cable 116 at all azimuthal angles, minimally impacting the radiation pattern of the omnidirectional antenna 102.

After traversing the radial gap 128, the α-polarized radiation 138 propagates through the second polarization converter 126, which rotates the linear polarization back to vertical. For many types of the polarization converters 110 and 126, residual absorption of the radiation 138 increases with the angle α. In this case, minimizing a will also minimize attenuation of the radiation 138 by the polarization converters 110 and 126. However, small values of a require more loops of the helix to bridge the vertical gap 140. This greater number of loops increases the arc length of the helix, resulting in greater attenuation of the signal 112 as it propagates along the cable 116. This cable loss may be prohibitive for certain applications, especially when the electrical signal 112 is high-frequency (e.g., several gigahertz). Those trained in the art will therefore recognize that a may be selected to balance between competing requirements for attenuation of the radiation 138 and attenuation of the signal 112. These requirements will depend on the application at hand. Accordingly, the helical angle θ may be any angle in the range (0°, 90°).

In some embodiments, the antenna feed 100 includes one or both of a top plate 134 and a bottom plate 132. Each of the plates 132 and 134 may be used to mechanically secure one or more of the cable 116, polarization converters 110 and 126, and omnidirectional antenna 102. For example, in FIG. 1, a connector 114 that is rigidly affixed to the bottom plate 132 mechanically constrains the lower end of the cable 116. Similarly, a connector 118 that is rigidly affixed to the top plate 134 mechanically constrains the upper end of the cable 116. These constraints may help the cable 116 maintain its position and helical shape within the radial gap 128 in the presence of mechanical disturbances (e.g., vibrations, acoustic shock, thermal expansion, drift, etc.). To further improve mechanical stability, the cable 116 may be rigid or semi-rigid coaxial cable.

A connector 108 that is rigidly affixed to the bottom plate 132 may be used to mechanically constrain the feedline 104, in turn helping to stabilize the position and orientation of the antenna 102. The feedline 104 may be rigid or semi-rigid coaxial cable. In some embodiments, the antenna feed 100 includes one or more of the connector 108, feedline 104, and antenna 102.

One or both of the top plate 134 and the bottom plate 132 may be formed of metal (e.g., aluminum or copper), thereby helping to shield components above and below the antenna feed 100 from radiation 138. In this case, it may be necessary for the bottom of the antenna 102 (in the z direction) to be located at least a few wavelengths above the upper face of the bottom plate 132 to ensure that the bottom plate 132 does not act as a counterpoise for the antenna 102. Similarly, the top of the antenna 102 may be located at least a few wavelengths below the bottom face of the top plate 134. Accordingly, the vertical gap 140 (as measured between the upper face of the bottom plate 132 and the lower face of the top plate 134) may be at least a few wavelengths longer than the vertical height of the antenna 102. One or both of the plate 132 and 134 may be machined with one or more pockets to reduce weight, or may alternatively be constructed at least partially with a wire mesh. Where shielding is not a concern, one or both of the plates 132 and 134 may be made at least partially of plastic, or another lightweight rigid material, to reduce weight.

The antenna feed 100 may also include a radome 130 that surrounds the antenna 102, polarization converters 110 and 126, and cable 116. As shown in FIGS. 1 and 2, the radome 130 may be shaped as a cylindrical shell coaxial with the antenna 102. However, the radome 130 may have another shape without departing from the scope hereof. The radome 130 may also affix to one or both of the top plate 134 and the bottom plate 132. For clarity in FIG. 1, only a cross-sectional view of the radome 130 is shown.

In some embodiments, the antenna feed 100 excludes the second polarization converter 126, and the α-polarized radiation 138 propagates away from the antenna feed 100 (i.e., outside of the radome 130). In this case, the combination of the antenna feed 100 and the omnidirectional antenna 102 acts as a slant-polarized omnidirectional antenna. When α=45°, the α-polarized radiation 138 will have vertical and horizontal electric-field components of similar magnitude. The resulting combination may be used to implement a polarization diversity scheme. In other embodiments, the second polarization converter 126 converts the α-polarized radiation 138 into circularly polarized radiation 138 (either left-hand or right-hand), which similarly has vertical and horizontal electric-field components of similar magnitude.

In some embodiments, the second polarization converter 126 rotates the α-polarized radiation 138 to another non-zero angle β≠α with respect to vertical. In this case, the radiation 138 propagates away from the antenna feed 100 as β-polarized radiation 138 (i.e., linearly polarized at the angle β). For example, the first polarization converter 110 may rotate the vertically polarized radiation 138 emitted by the antenna 102 to α=30°, and the second polarization converter 126 may rotate the α-polarization radiation 138 to β=45°. In another example, a is close to 90°, wherein the cable 116 runs almost vertically (see FIG. 5). The second polarization converter 126 may then rotate the α-polarization radiation 138 back to β=45°. Other combinations of a and may be used without departing from the scope hereof.

In some embodiments, the antenna 102 emits radiation 138 that is circularly (either left-hand or right-hand) or elliptically polarized. In this case, the first polarization converter 110 converts the radiation 138 into α-polarized radiation 138. The second polarization converter 126 then converts the α-polarized radiation 138 polarization back to circular or elliptical polarization. Alternatively, the second polarization converter 126 may rotate the α-polarized radiation 138 into β-polarized radiation 138. Alternatively, the second polarization converter 126 may be omitted such that the α-polarized radiation 138 propagates away from the antenna feed 100.

Figure 4:
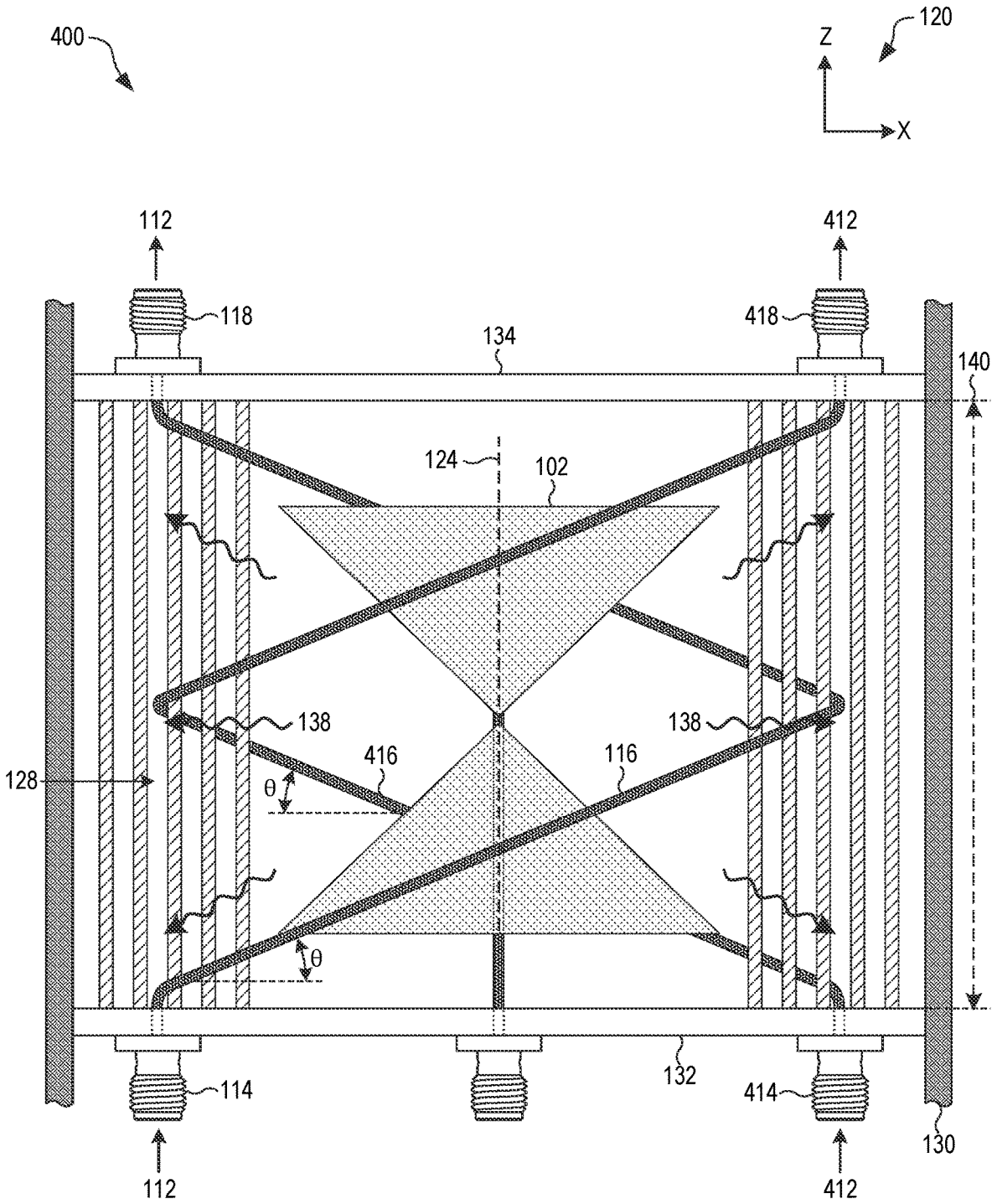
FIG. 4 shows a side view of an antenna feed conducting two electrical signals around the omnidirectional antenna of FIGS. 1 and 2, in an embodiment.

FIG. 4 shows a side view of an antenna feed 400 conducting two electrical signals around the omnidirectional antenna 102. The antenna feed 400 is an embodiment of the antenna feed 100 of FIGS. 1 and 2 that includes a second cable 416 to conduct a second electrical signal 412 across the vertical gap 140. Like the cable 116, the second cable 416 is also shaped as a helix that is coaxial with the antenna 102, winds around the antenna 102 with a helical angle θ, and runs through the radial gap 128 between the polarization converters 110 and 126. However, the second cable 416 is rotated, relative to the cable 116, by 180° about the axis 124 so that it does not physically interfere with the cable 116. Also like the cable 116, α-polarized radiation 138 will not excite the metal of the cable 416, and will instead propagate through the cable 416 with minimal loss and distortion. Accordingly, the cables 116 and 416 have the same helicity. In FIG. 4, each of the cables 116 and 416 forms a left-handed helix. However, each of the cables 116 and 416 may alternatively form a right-handed helix without departing from the scope hereof.

In some embodiments of the antenna feed 400, the second cable 416 is rotated, relative to the cable 116, by an angle other than 180° about the axis 124 (e.g., 90°, 45°, 270°, etc.). In some embodiments, the antenna feed 400 contains one or more additional cables for conducting one or more additional electrical signals around the omnidirectional antenna 102. Like the cables 116 and 416, each additional cable is shaped as a helix that is coaxial with the antenna 102, winds around the antenna 102 with a helical angle θ, and runs through the radial gap 128 between the polarization converters 110 and 126. Each additional cable may be rotated about the axis 124 by a unique angle so that the cable 116, the cable 416, and the one or more additional cables do not physically interfere with each other. Like the cables 116 and 416, α-polarized radiation 138 will not excite metal in any of the one or more additional cables, instead propagating through the one or more additional cables with minimal loss and distortion (i.e., without reflecting off the metal). Accordingly, the one or more additional cables have the same helicity as the cables 116 and 416.

The antenna feed 400 may also include a connector 414 that is rigidly affixed to the bottom plate 132 to mechanically constrain the lower end of the second cable 416, and a connector 418 that is rigidly affixed to the top plate 134 to mechanically constrain the upper end of the second cable 416. These mechanical constraints may help the second cable 416 maintain its position and helical shape within the radial gap 128 in the presence of mechanical disturbances. Each of the one or more additional cables may also have a connector rigidly affixed to the bottom plate 132, and a connector rigidly affixed to the top plate 134.

Figure 5:
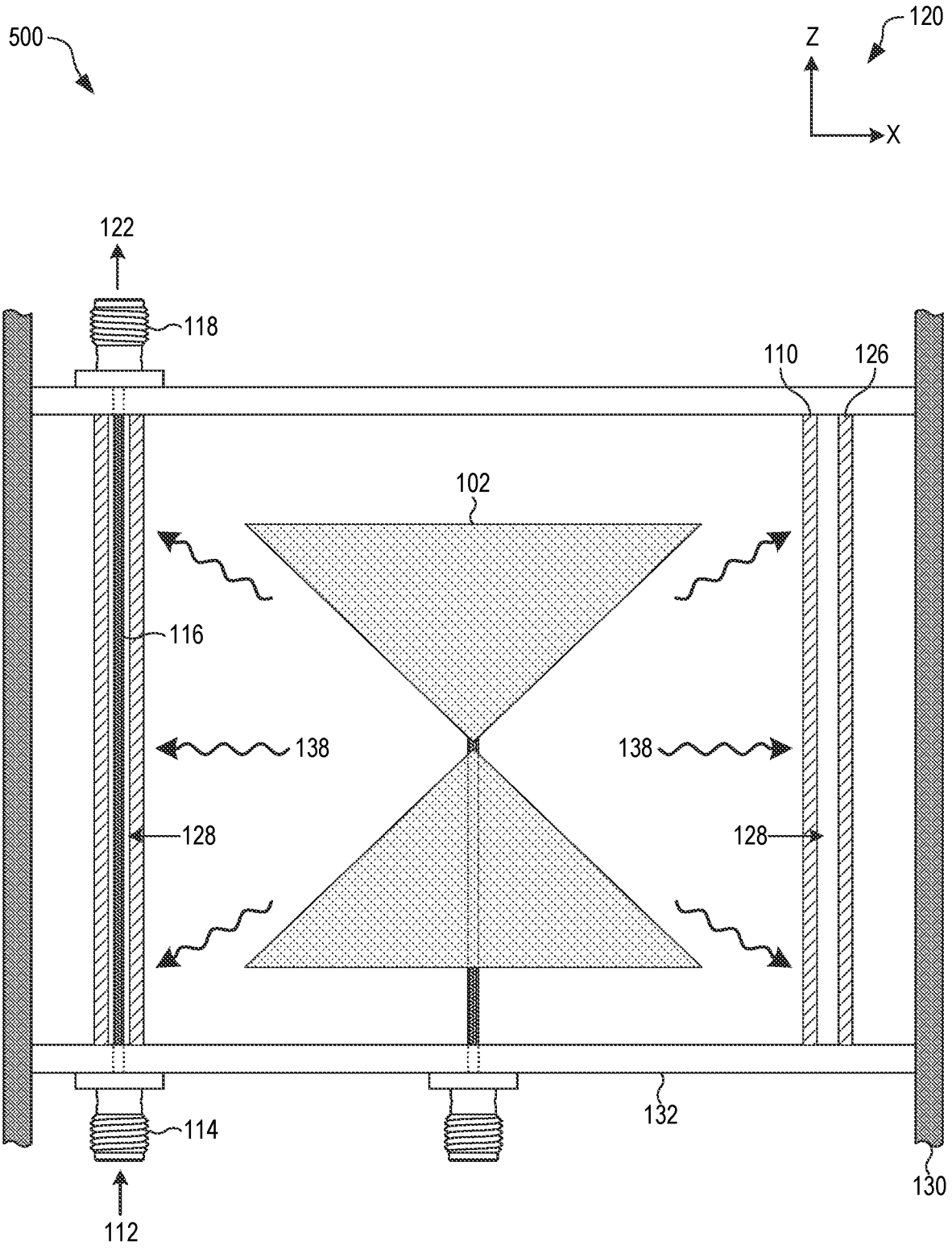
FIG. 5 shows a side view of an antenna feed conducting an electrical signal vertically past the omnidirectional antenna of FIGS. 1 and 2, in an embodiment.

FIG. 5 shows a side view of an antenna feed 500 conducting the electrical signal 112 vertically past the omnidirectional antenna 102. The antenna feed 500 is an embodiment of the antenna feed 100 in which α=90°, i.e., α-polarized radiation 138 propagating through the radial gap 128 is linearly polarized in the horizontal x-y plane. The cable 116 therefore forms a straight line rather than a helix. Advantageously, this embodiment minimizes the length of the cable 116. Like the antenna feed 400 of FIG. 4, the antenna feed 500 may contain one or more additional cables that conduct one or more additional electrical signals vertically past the antenna 102. Each of these one or more additional cables also forms a straight vertical line, and may run along a different azimuthal section of the radial gap 128 such that none of the cables physically interfere with each other.

Antenna Systems

Figure 6:
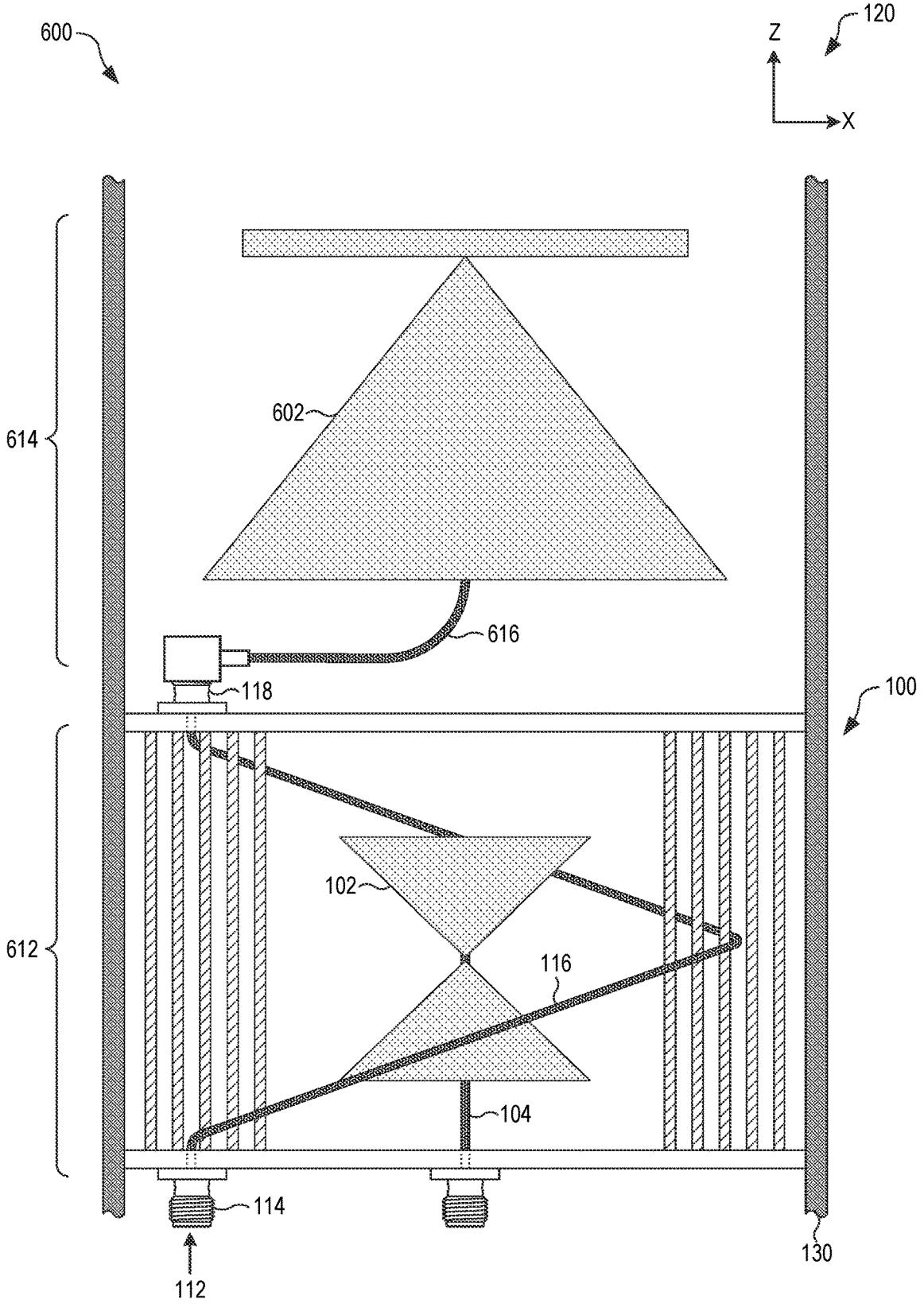
FIG. 6 is a side view of a stackable antenna system that combines the antenna feed and omnidirectional antenna of FIGS. 1 and 2 with a second antenna, in an embodiment.

FIG. 6 is a side view of a stackable antenna system 600 that combines the antenna feed 100 and omnidirectional antenna 102 of FIGS. 1 and 2 with a second antenna 602. The antenna system 600 includes a lower antenna module 612 that combines the antenna feed 100 and the omnidirectional antenna 102, and an upper antenna module 614 that combines the second antenna 602 with a feedline 616. The upper module 614 is stacked on top of the lower module 612, i.e., the upper module 614 is located vertically above (i.e., in the +z direction) the lower module 612 and may use the lower module 612 for mechanical support. In the lower module 612, the antenna feed 100 conducts the electrical signal 112 around the omnidirectional antenna 102 to the feedline 616, which connects between the connector 118 and the second antenna 602. However, the antenna system 600 may exclude the connector 118 and feedline 616, wherein the cable 116 extends vertically upward to directly feed the second antenna 602.

The second antenna 602 is shown in FIG. 6 as a discone antenna, but may be another type of antenna without departing from the scope hereof. For example, the second antenna 602 may be another type of omnidirectional antenna, a directional antenna, or an antenna array. The cables 616 and 116 may conduct electrical signals in either direction, and therefore the second antenna 602 may be used for receiving or transmitting. In some embodiments, the lower antenna module 612 uses the antenna feed 400 of FIG. 4 to conduct more than one electrical signal vertically to the upper antenna module 614. For example, when the second antenna 602 is an array of N antenna elements, where N≥1, the antenna feed 400 may use N cables to conduct N electrical signals to the N antenna elements.

The antennas 102 and 602 may operate over different bands, in which case the stackable antenna system 600 is dual-band. In FIG. 6, the second antenna 602 is shown with a diameter larger than that of the omnidirectional antenna 102 to indicate that it operates at a lower-frequency band. For example, the omnidirectional antenna 102 may operate between 18 and 40 GHz (i.e., the K and Ka bands) while the second antenna 602 operates between 12 and 18 GHz (i.e., the Ku band). However, each of the antennas 102 and 602 may operate over a different band or frequency range without departing from the scope hereof. The antennas 102 and 602 may operate over the same band or frequency range. Alternatively, the frequency ranges over which the antennas 102 and 602 operate may at least partially overlap.

Since cable loss generally increases with frequency, and the cable length needed to feed the second antenna 602 will likely be longer than that needed to feed the omnidirectional antenna 102 (i.e., the combined length of the cables 116 and 616 is greater than the length of the feedline 104), cable loss may be reduced by selecting the second antenna 602 to operate at lower frequencies than the omnidirectional antenna 102. Accordingly, in some embodiments a highest operating frequency of the omnidirectional antenna 102 is greater than a highest operating frequency of the second antenna 602. In some embodiments, the lowest operating frequency of the omnidirectional antenna 102 is greater than the highest operating frequency of the second antenna 602. However, the second antenna 602 may operate at higher frequencies than the omnidirectional antenna 102 without departing from the scope hereof.

Figure 7:
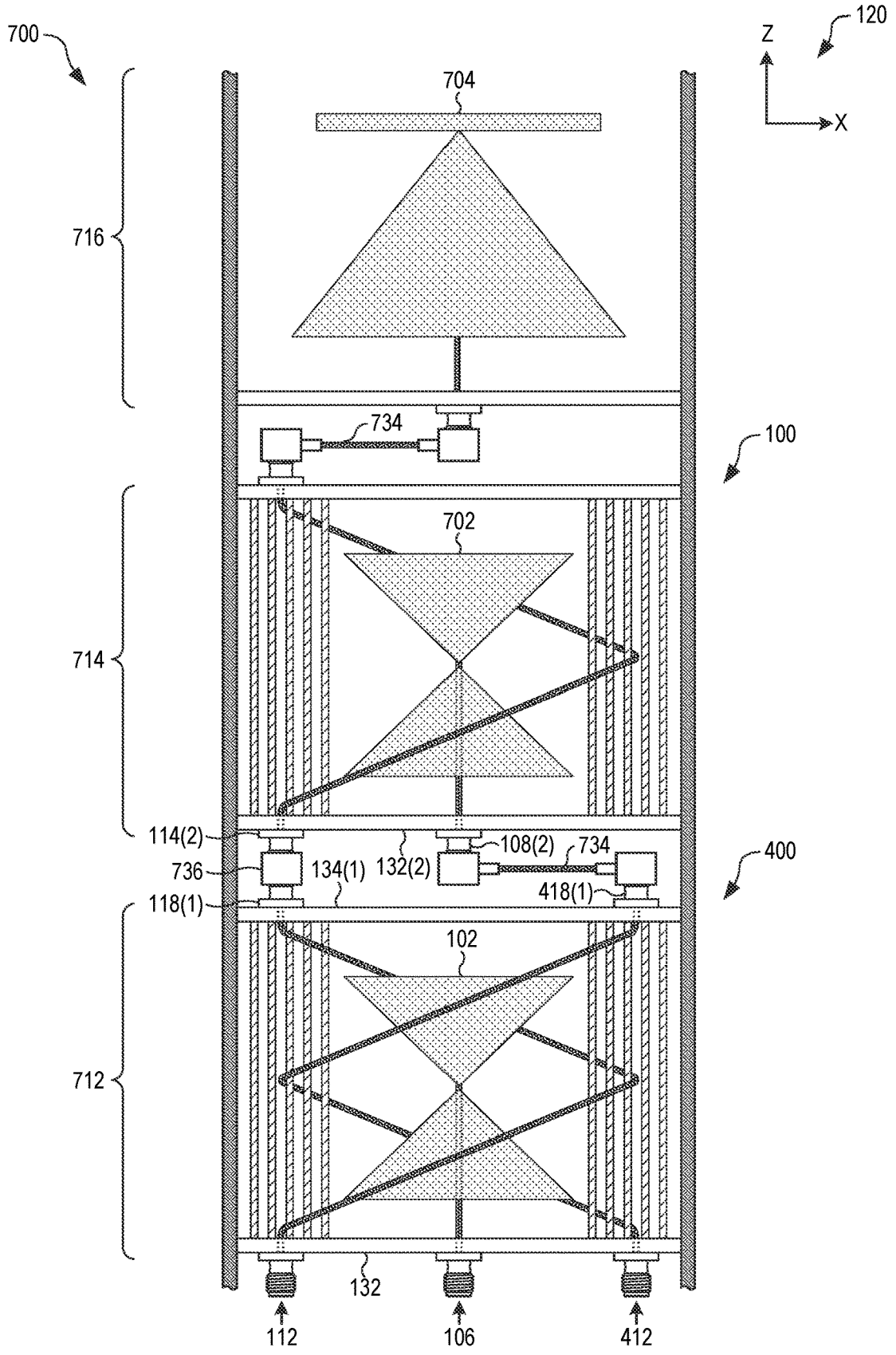
FIG. 7 is a side view of a stackable antenna system that combines lower, middle, and upper antenna modules, in an embodiment.

FIG. 7 is a side view of a stackable antenna system 700 that combines lower, middle, and upper antenna modules 712, 714, and 716. The lower antenna module 712 is similar to the lower antenna module 612 of FIG. 6 except that it uses the antenna feed 400 to conduct the two electrical signals 112, 412 around the omnidirectional antenna 102 along two cables. The middle antenna module 714 includes a second omnidirectional antenna 702 that is driven by the electrical signal 412. The middle antenna module 714 also includes the antenna feed 100 of FIG. 1 to conduct the electrical signal 112 around the second omnidirectional antenna 702. The top antenna module 716 includes a third antenna 704 that is driven by the electrical signal 112. Similar to the antenna 614 of FIG. 6, the third antenna 704 may be any type of antenna (e.g., directional, array, etc.), and is therefore not required to be omnidirectional.

The stackable antenna systems 600 and 700 may be extended to include additional stackable modules (i.e., a total of four or more). Therefore, in embodiments a stackable antenna system includes a vertical sequence of antenna modules. With the exception of the topmost antenna module, each antenna module of the sequence combines an omnidirectional antenna with the antenna feed 100 to conduct one or more electrical signals vertically to the next module of the sequence. The lowest module in the sequence (e.g., the lower module 712 in FIG. 7) will therefore have the greatest number of cables conducting electrical signals therethrough. Any module of the sequence may utilize more than one electrical signal.

Referring to FIG. 7, each of the antennas 102, 702, and 704 may operate over any band or frequency range. Furthermore, each of the modules 714 and 716 may transmit radiation at any polarization. For example, the lower module 712 may transmit linearly polarized radiation at $\alpha=45°$ while the middle module 714 transmits linearly polarized radiation at $\alpha=-45°$. In this example, the lower and middle modules 712, 714 cooperate to form a dual-polarized antenna system. Also in this example, the different signs of a means that cables in the lower module 712 will have the opposite helicity of cables in the middle module 714.

In FIG. 7, the lower module 712 contains a top plate 134(1) and the middle module 714 contains a lower plate 132(2). The middle module 714 may be configured so that when it is stacked on top of the lower module 712, a second connector 114(2) affixed to the bottom plate 132(2) is aligned with a corresponding first connector 118(1) affixed to the top plate 134(1). This alignment advantageously allows the connectors 118(1) and 114(2) to directly engage with each other. For example, one of the connectors 118(1), 114(2) may be female, with the other being male. Alternatively, the connectors 118(1) and 114(2) may be engaged via a barrel connector 736. Similarly aligned connectors may be used between the top plate of the middle module 714 and the lower plate of the upper module 716.

FIG. 7 also shows a fourth connector 108(2) affixed to the bottom plate 132(2) that does not align with a corresponding third connector 418(1) that is affixed to the top plate 134(1). In this case, an inter-module cable 734 is used to engage with the connectors 418(1) and 108(2). Another inter-module cable 734 may also be used between the top plate of the middle module 714 and the lower plate of the upper module 716.

Regardless of how electrical connectors between modules are engaged, the use of electrical connectors allows the antenna modules 712, 714, and 716 to be easily removed for service or repair, or to be replaced with another module (e.g., containing a different type of antenna, or an antenna that operates over a different band). However, any of the stackable antenna systems herein may exclude one or more of the electrical connectors (e.g., electrical connectors 108, 114, 118, 414, 418), inter-module cables 734, barrel connector 736, top plates 134, and bottom plates 136 without departing from the scope hereof.

Polarization Converters

The polarization converters 110 and 126 may be any transmissive structure that converts the polarization state of the electromagnetic radiation 138. For example, in FIGS. 1 and 2, each of the polarization converters 110 and 126 is a multi-screen polarizer formed from n wire-grid polarizer sheets, where n is any positive integer. Specifically, the first polarization converter 110 is a three-layer multi-screen polarizer formed from n=3 nested polarizer sheets, each of which is shaped as a cylindrical shell that is coaxial with the antenna 102. Similarly, the second polarization converter 126 is a two-layer multi-screen polarizer formed from n=2 nested polarizer sheets, each of which is also shaped as a cylindrical shell that is coaxial with the antenna 102. Each of the polarizer sheets may continuously surround the antenna 102 about its axis 124 (i.e., without gaps, openings, or other discontinuities).

Figure 8:
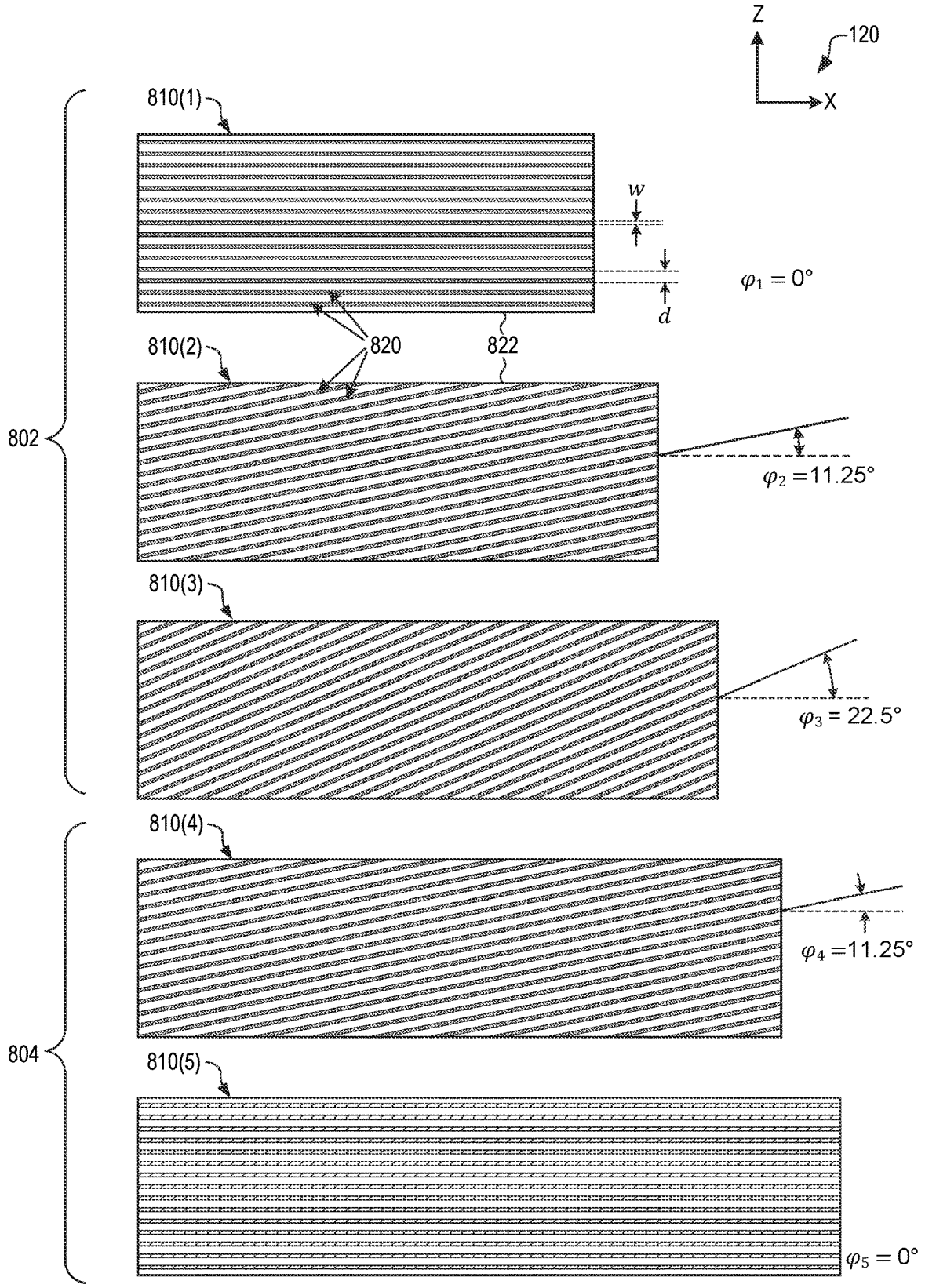
FIG. 8 shows two examples of multi-screen polarizers, in an embodiment.

FIG. 8 shows two examples of multi-screen polarizers. Specifically, a three-layer multi-screen polarizer 802 includes a first polarizer sheet 810(1), a second polarizer sheet 810(2), and a third polarizer sheet 810(3). A two-layer multi-screen polarizer 804 includes a fourth polarizer sheet 810(4) and a fifth polarizer sheet 810(5). The three-layer multi-screen polarizer 802 may be used as the first polarization converter 110, and the two-layer multi-screen polarizer 804 may be used for the second polarization converter 126. Each polarizer sheet 810 may be fabricated with a flexible dielectric substrate 822 such that it can be easily rolled into a cylindrical shell. For clarity in FIG. 8, each polarizer sheet 810 is shown unrolled, i.e., as a flat rectangular sheet. The first polarizer sheet 810(1) is radially closest to the antenna 102, and therefore will have the smallest radius when rolled into a cylindrical shell. Accordingly, the first polarizer sheet 810(1) is shorter, in the x direction, than all of the other polarizer sheets 810. Similarly, the fifth polarizer sheet 810(5) is radially farthest from the antenna 102, and therefore will have the largest radius when rolled into a cylindrical shell. Accordingly, the fifth polarizer sheet 810(5) is longer, in the x direction, than all of the other polarizer sheets 810.

Each polarizer sheet 810 is a wire-grid polarizer having several parallel wires 820 uniformly spaced by a distance d. Each wire 820 has a width w that is less than one-half of the wavelength of the electromagnetic radiation 138, and therefore each polarizer sheet 810 transmits only the component of the oscillating electric field that is perpendicular to the length of the wires 820 (i.e., parallel to the width w), both reflecting and absorbing the component of the oscillating electric field that is parallel to the length of the wires 820. For example, the first polarizer sheet 810(1) has wires 820 that run parallel to the x direction, and therefore form a first angle $\varphi_1=0°$ relative to the +x axis. Therefore, the first polarizer sheet 810(1) only transmits radiation that is vertically polarized (i.e., along the z direction). The second polarizer sheet 810(2) has wires 820 oriented at a second angle $\varphi_2>\varphi_1$ relative to the x direction, and therefore only transmits radiation polarized at the second angle $\varphi_2$ relative to the +z axis. Similarly, the third polarizer sheet 810(3) has wires 820 oriented at a third angle $\varphi_3>\varphi_2$ relative to the x direction, and therefore only transmits radiation polarized at the third angle $\varphi_2$ relative to the +z axis.

In the example of FIG. 8, the radial gap 128 occurs between the third polarizer sheet 810(3) and the fourth polarizer sheet 810(4), and therefore the α-polarized radiation 138 will be linearly polarized at the angle $\alpha=\varphi_2=22.5°$ relative to the +z axis. Accordingly, the cable 116 will form a helix with a helical angle $\theta=\alpha=22.5°$. The fourth polarizer sheet 810(4) has wires 820 oriented at a fourth angle $\varphi_4<\varphi_3$ relative to the x direction, and therefore only transmits radiation polarized at the angle $\varphi_4$ relative to the +z axis. Finally, the fifth polarizer sheet 810(5) has wires 820 parallel to the x direction. Accordingly, the radiation 138 propagating away from the antenna feed 100 will be vertically polarized.

Each of the multi-screen polarizers 802 and 804 may be formed with a different number of layers without departing from the scope hereof. In fact, loss can be reduced by increasing the number of layers such that the change in polarization angle $\Delta\varphi=\varphi_i-\varphi_{i-1}$ between neighboring polarizer sheets 810($i$) and 810($i-1$) is reduced. For example, the first polarization converter 110 could alternatively be formed from seven polarizer sheets 810 whose wires 820 are oriented at angles $\varphi_1=0°$, $\varphi_2=3.75°$, $\varphi_3=7.5°$, $\varphi_4=10.75°$, $\varphi_5=14.5°$, $\varphi_6=18.25°$, and $\varphi_7=22.5°$ relative to the x direction. This seven-layer multi-screen polarizer has less theoretical loss than the three-layer multi-screen polarizer 802. Similarly, a six-layer multi-screen polarizer could then rotate the polarization from 22.5° back to 0° with less theoretical loss than the two-layer multi-screen polarizer 804.

To better appreciate the effect of the number of layers on loss, consider an n-layer multi-screen polarizer that rotates radiation initially polarized along an initial polarization angle) $\alpha^{(0)}$ into radiation polarized along a final polarization angle $\alpha^{(f)}$. Thus, in FIG. 8 $\alpha^{(0)}=0°$ and $\alpha^{(f)}=22.5°$ for the three-layer multi-screen polarizer 802, and $\alpha^{(0)}=22.5°$ and $\alpha^{(f)}=0°$ for the two-layer multi-screen polarizer 804. Assume that each of the n layers is a single wire-grid polarizer sheet (e.g., any one of the polarizer sheets 810) whose wires are oriented at an angle $\Delta\varphi=\Delta\alpha/n$ relative to the previous layer, where $\Delta\alpha=(\alpha^{(f)}-\alpha^{(0)})$. Thus, in FIG. 8 $\Delta\alpha=11.25°$ for the three-layer multi-screen polarizer 802 and $\Delta\alpha=-11.25°$ for the two-layer multi-screen polarizer 804. The polarization angle at the output of the $n^{th}$ layer is $\alpha^{(0)}+n\Delta\varphi=\alpha^{(0)}+\Delta\alpha=\alpha^{(f)}$, as expected. However, the amplitude transmission through all n layers is $T=(\cos(\Delta\varphi))^n$, which can be Taylor expanded under the assumption that $\Delta\varphi$ is small to obtain $T\approx(1-(\Delta\varphi)^2)^n\approx1-n(\Delta\varphi)^2=1-(\Delta\alpha)^2/n$. Accordingly, the theoretical loss, defined as $(\Delta\alpha)^2/n$, decreases as n increases (i.e., as $\Delta\varphi$ decreases).

In practice, each polarizer sheet 810 introduces residual loss (e.g., absorption in the substrate 322, scattering from edges, etc.). Considering all n layer of a multi-screen polarizer, the total residual loss increases with n. Accordingly, there exists an optimal number of layers that minimizes the theoretical loss before the total residual loss dominates. Furthermore, the theoretical loss increases with Δα. As such, selecting the maximum value of $\Delta\alpha=90°$ may result in too much loss for the application at hand, even though this choice of Δα minimizes cable loss.

While the example of FIG. 8 shows the multi-screen polarizer 802 configured to rotate polarization from the initial polarization angle $\alpha^{(0)}=0°$ into the final polarization angle $\alpha^{(f)}=22.5°$, the multi-screen polarizer 802 may be configured for any initial polarization angle $\alpha^{(0)}$ and any final polarization angle $\alpha^{(f)}$ without departing from the scope hereof. Accordingly, Δα may be any non-zero value between −90° and +90°.

Figure 9:
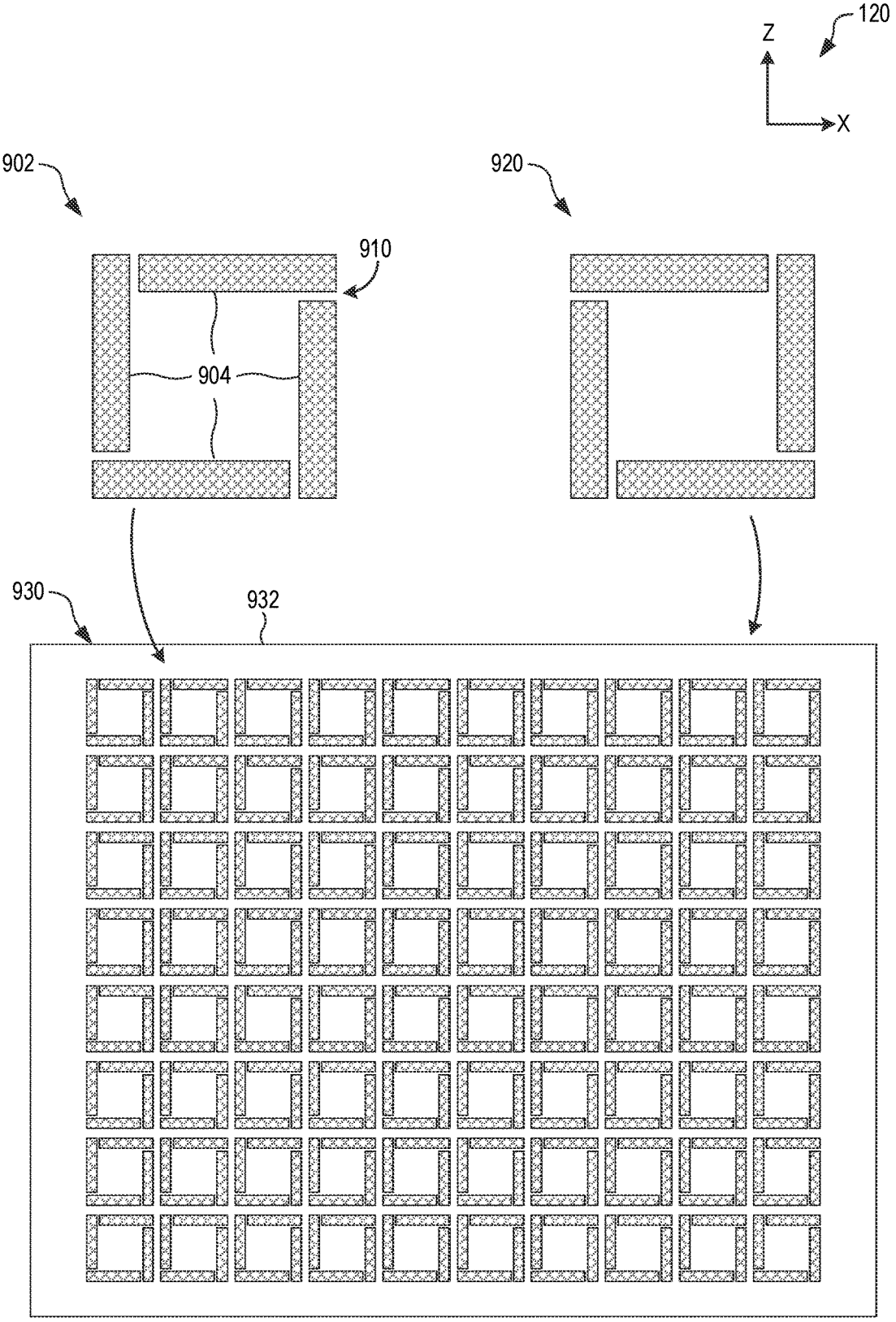
FIG. 9 shows a bilayered chiral metamaterial that rotates polarization by 90°.

FIG. 9 shows a bilayered chiral metamaterial 930 that rotates polarization by 90°, and therefore is another example of a polarization converter. Accordingly, the metamaterial 930 may be used for one or both of the polarization converters 110 and 126. Similar to the polarizer sheets 810 of FIG. 8, the metamaterial 930 may be fabricated from metal deposited onto a flexible dielectric substrate 932 that can be easily wrapped into a cylindrical shell. The metamaterial 930 offers a high polarization conversion efficiency and a high axial ratio of the transmitted radiation. Compared to the multi-screen polarizers 802 and 804, the metamaterial 930 may advantageously consist of only one layer.

On an obverse side of the substrate 932 is a first frequency-selective surface formed from a first chiral pattern 902 that repeats in the x and z dimensions. The first chiral pattern 902 has four metallic (e.g., copper) segments 904 arranged as a square having four-fold rotational symmetry in the x-z plane. However, gaps 910 between neighboring segments 904 are located to break the mirror symmetry of the square. On the reverse side of the substrate 932 is a second frequency-selective surface formed from a second chiral pattern 920 that is the enantiomeric pair of the first chiral pattern 902 (i.e., the chiral patterns 902 and 920 are mirror images of each other). More details about the metamaterial 930 can be found in Yuqian Ye and Sailing He, "90° polarization rotator using a bilayered chiral metamaterial with giant optical activity", Appl. Phys. Lett. 96, 203501 (2010).

The bilayered chiral metamaterial 930 is just one of several transmissive polarizers that are based on chiral metamaterials and frequency-selective surfaces and known in the art. Any one of these metamaterial-based or frequency-selective-surface-based transmissive polarizers may be used for one or both of the polarization converters 110 and 126 without departing from the scope hereof. Like the metamaterial 930, many of these metamaterials or frequency-selective surfaces may be fabricated with a flexible substrate that can be rolled into a cylindrical shell. Furthermore, while the metamaterial 930 rotates polarization by 90°, a different metamaterial or frequency-selective surface may be used to rotate polarization by an angle other than 90°. Alternatively, a metamaterial or frequency-selective surface may be used to implement a circular polarizer. Different types of metamaterials and frequency-selective surfaces (i.e., with different unit cells) may be combined to create a metamaterial-based or frequency-selective-surface-based multi-layer polarization converter.

Figure 10:
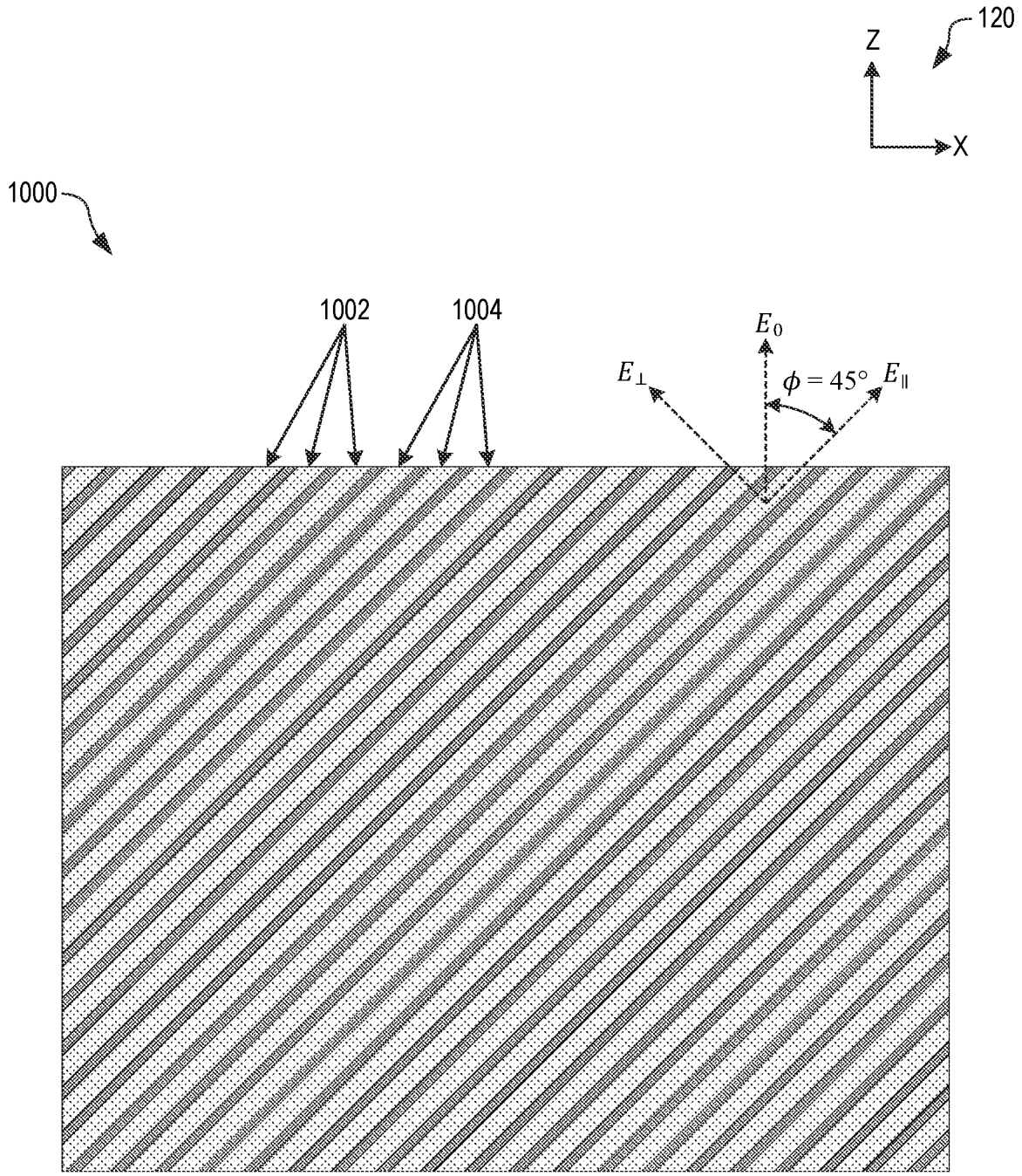
FIG. 10 shows a waveplate.

FIG. 10 shows a waveplate 1000 that may be used for one or both of the polarization converters 110 and 126. The waveplate 1000 is formed from alternating layers of a first dielectric material 1002 having a relatively high permittivity, and a second dielectric material 1004 having a relatively low permittivity. Both dielectric materials 1002 and 1004 are low-loss. Thus, the waveplate 1000 contains only dielectric materials (i.e., no metal). Where the dielectric materials 1002 and 1004 are flexible, the waveplate 1000 may be fabricated as a sheet that can be rolled into a cylindrical shell, similar to the polarizer sheets 810 of FIG. 8. Alternatively, the waveplate 1000 may be machined, or otherwise formed, as a cylindrical shell.

Consider the electric field $E_0$ of an incident electromagnetic wave that propagates along the y direction and is vertically polarized along the z direction. The waveplate 1000 is shown in FIG. 10 with each of the alternating layers oriented at $\phi$=45° relative to the vertical polarization of the wave. In this case, the electric field $E_0$ may be decomposed into a parallel component $E_{\parallel}$ that is parallel to the layers, and a perpendicular component $E_{\perp}$ that is perpendicular to the layers. The waveplate 1000 delays the parallel component $E_{\parallel}$ by a first phase shift, and the perpendicular component $E_{\perp}$ by a second phase shift different from the first phase shift. The thickness of the waveplate 1000 in the y direction may be selected such that the difference between the first and second phase shifts equals 180° (or any odd multiple thereof). In this case, the transmitted radiation will be horizontally polarized, i.e., the waveplate 1000 acts as a 90° polarization rotator. The alternating layers may be oriented at a different angle 4), relative to the initial linear polarization, to rotate the polarization by less than 90°. Alternatively, the thickness of the waveplate 1000 may be selected such that the difference between the first and second phase shifts equals 45°, in which case the waveplate 1000 converts linearly polarized radiation into circularly polarized radiation (and vice versa). More details about the waveplate 1000 can be found in Junming Zhao et al. "A Wide-angle Multi-Octave Broadband Waveplate Based on Field Transformation Approach", Scientific Reports Sci Rep 5, 17532 (2015).

The waveplate 1000 is just one of several transmissive all-dielectric polarizers known in the art, any of which may be used for one or both of the polarization converters 110 and 126 without departing from the scope hereof. For example, a cylindrical artificial anisotropic polarizer is described in C. Ding and K. Luk, "Wideband Omnidirectional Circularly Polarized Antenna for Millimeter-Wave Applications Using Printed Artificial Anisotropic Polarizer," 2019 IEEE International Symposium on Antennas and Propagation and USNC-URSI Radio Science Meeting, Atlanta, Ga., USA, 2019, pp. 1103-1104. As another example, waveplates based on dielectric resonators are described in A. Yahyaoui et al., "Half-wave and quarter-wave plates metasurfaces with elliptic dielectric resonators for microwave applications," 2016 16th Mediterranean Microwave Symposium, Abu Dhabi, 2016, pp. 1-4. Different types of all-dielectric polarizers may be combined to create a multi-layer all-dielectric polarization converter. Furthermore, one or more all-dielectric polarizers may be combined with one or more metamaterial-based or frequency-selective-surface-based transmissive polarizers to create a hybrid multi-layer polarization converter.

Figure 11:
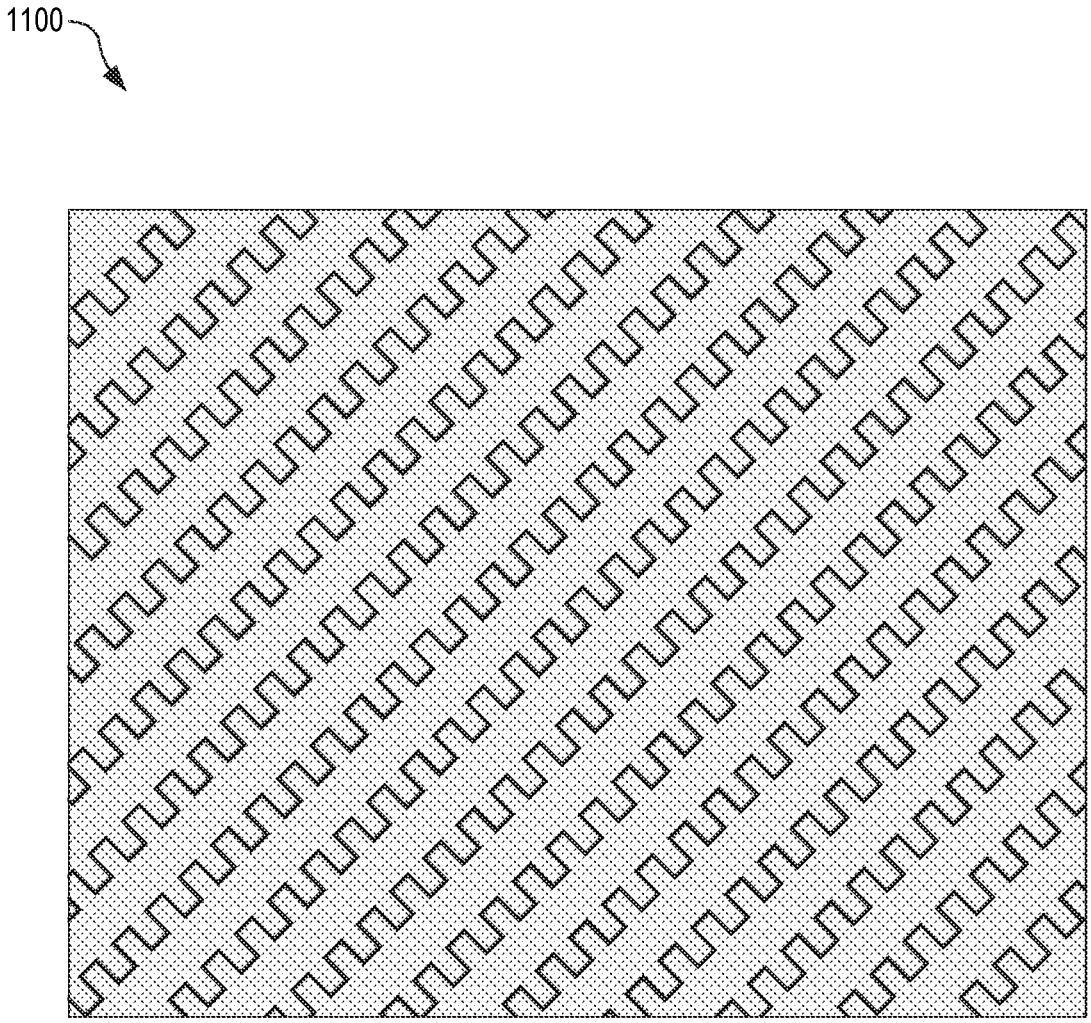
FIG. 11 shows a meander-line polarizer that converts linearly polarized radiation into circularly polarized radiation, and vice versa.

FIG. 11 shows a meander-line polarizer 1100 that converts linearly polarized radiation into circularly polarized radiation, and vice versa, and therefore is another example of a polarization converter. Accordingly, the meander-line polarizer 1100 may be used for one or both of the polarization converters 110 and 126. Similar to the polarizer sheets 810 of FIG. 8, the meander-line polarizer 1100 may be fabricated from metal deposited onto a flexible dielectric substrate that can be easily wrapped into a cylindrical shell. The meander-line polarizer 1100 may be used as a layer of any of the afore-mentioned multi-layer polarization converters.

For clarity in the preceding discussion, each example of the polarization converters 110 and 126 is described as forming a cylindrical shell. However, one or both of the polarization converters 110 and 126 (e.g., the polarizer sheets 810, bilayered chiral metamaterial 930, waveplate 1000, and meander-line polarizer 1100) may form a non-cylindrical shell with a non-circular cross-sectional shape (e.g., square tube, rectangular tube, hexagonal tube, octagonal tube, etc.) without departing from the scope hereof.

Method Embodiments

An antenna feeding method includes emitting, with an omnidirectional antenna, electromagnetic fields having an initial polarization. For example, the omnidirectional antenna 102 of FIG. 1 emits electromagnetic radiation 138 that is vertically polarized. The antenna feeding method also includes converting, using a first polarization converter continuously surrounding the omnidirectional antenna, the initial polarization into a linear polarization. For example, the first polarization converter 110 of FIG. 1 rotates the vertical polarization of radiation 138 emitted by the omnidirectional antenna 102 into a non-vertical linear polarization. The antenna feeding method also includes feeding a second antenna located above the omnidirectional antenna with a feedline located outside of the first polarization converter, with respect to the omnidirectional antenna, and oriented perpendicularly to the linear polarization. For example, the stackable antenna system 600 includes the cable 116, which conducts the signal around the omnidirectional antenna 102 such that the cable 116 runs perpendicular to the $\alpha$-polarized radiation. After passing the omnidirectional antenna 100, the cable 116 feeds the second antenna 602. Said feeding the second antenna may include one or both of transmitting an electrical signal to the second antenna via the feedline, and receiving an electrical signal from the second antenna via the feedline.

In some embodiments of the antenna feeding method, the linear polarization is oriented at a non-zero angle relative to an antenna axis of the omnidirectional antenna. The feedline may form a helix aligned parallel to the antenna axis and having a helical angle similar to the non-zero angle. For example, when the antenna feed 100 of FIGS. 1 and 2 uses the three-layer multi-screen polarizer 802 of FIG. 8, the linear polarization of the radiation 138 in the radial gap 128 will form the angle $\alpha$=22.5° relative to the vertical direction. In this case, the cable 116 may be shaped as a helix that is coaxial with the omnidirectional antenna 102 and has a helical angle $\theta=\alpha$=22.5°. In some embodiments, the non-zero angle is 90°. For example, in the antenna feed 500 of FIG. 5, the $\alpha$-polarized radiation 138 is linearly polarized with $\alpha$=90° in the radial gap 126. In some embodiments, the initial polarization is linear and parallel to the antenna axis. For example, the omnidirectional antenna 102 of FIGS. 1 and 2 is shown as biconical antenna that emits vertically polarized radiation. In other embodiments, the initial polarization is circular.

In some embodiments, the antenna feeding method includes converting, using a second polarization converter continuously surrounding the first polarization converter, the linear polarization into a final polarization. For example, the second polarization converter 126 of FIGS. 1 and 2 may rotate the $\alpha$-polarized radiation 138 in the radial gap 128 such that the radiation 138 propagates away from the antenna feed 100 with a final polarization that is different from the linear polarization. The final polarization may be linear and parallel to the initial polarization. For example, when the antenna feed 100 uses the two-layer multi-screen polarizer 804 of FIG. 8, the final polarization will be linear and vertical, similar to the initial polarization emitted by the omnidirectional antenna 102. Alternatively, the final polarization may be circular.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An antenna feed, comprising:

a first polarization converter continuously surrounding an omnidirectional antenna that emits, toward the first polarization converter, electromagnetic fields having an initial polarization, the first polarization converter being oriented to convert the initial polarization into a linear polarization;

a second polarization converter continuously surrounding the first polarization converter and oriented to convert the linear polarization into a final polarization; and a feedline located between the first and second polarization converters and oriented perpendicularly to the linear polarization.

2. The antenna feed of claim 1, wherein the linear polarization is oriented at a non-zero angle relative to an antenna axis of the omnidirectional antenna.

3. The antenna feed of claim 2, wherein the feedline forms a helix aligned parallel to the antenna axis and having a helical angle similar to the non-zero angle.

4. The antenna feed of claim 2, the non-zero angle being ninety degrees.

5. The antenna feed of claim 2, wherein the initial polarization is linear and parallel to the antenna axis.

6. The antenna feed of claim 2, where in the initial polarization is circular.

7. The antenna feed of claim 1, wherein the first polarization converter is shaped as a cylindrical shell that is coaxial with an antenna axis of the omnidirectional antenna.

8. The antenna feed of claim 1, wherein the first polarization converter is selected from the group consisting of: a multi-screen polarizer, a meander-line polarizer, a waveplate, an artificial anisotropic polarizer, and a frequency-selective surface.

9. The antenna feed of claim 1, wherein the final polarization is linear and not parallel to the linear polarization.

10. The antenna feed of claim 1, wherein the final polarization is circular.

11. The antenna feed of claim 1, wherein the second polarization converter is shaped as a cylindrical shell that is coaxial with an antenna axis of the omnidirectional antenna.

12. The antenna feed of claim 1, wherein the second polarization converter is selected from the group consisting of: a multi-screen polarizer, a meander-line polarizer, a waveplate, an artificial anisotropic polarizer, and a frequency-selective surface.

13. The antenna feed of claim 1, wherein the feedline connects to a second antenna placed above the omnidirectional antenna.

14. The antenna feed of claim 13, wherein a highest operating frequency of the omnidirectional antenna is greater than a highest operating frequency of the second antenna.

15. The antenna feed of claim 1, wherein the omnidirectional antenna is selected from the group consisting of: a biconical antenna, a monocone antenna, and a discone antenna.

16. An antenna assembly, comprising:

the antenna feed of claim 1; and the omnidirectional antenna.

17. The antenna assembly of claim 16, further comprising a second antenna placed above the omnidirectional antenna;

wherein the feedline connects to the second antenna.

18. An antenna feeding method, comprising:

emitting, with an omnidirectional antenna, electromagnetic fields having an initial polarization;

converting, using a first polarization converter continuously surrounding the omnidirectional antenna, the initial polarization into a linear polarization;

converting, using a second polarization converter continuously surrounding the first polarization converter, the linear polarization into a final polarization; and feeding a second antenna located above the omnidirectional antenna with a feedline located between the first and second polarization converters and oriented perpendicularly to the linear polarization.

19. The antenna feeding method of claim 18, wherein said feeding includes one or both of:

transmitting an electrical signal to the second antenna via the feedline; and receiving an electrical signal from the second antenna via the feedline.

20. The antenna feeding method of claim 18, wherein the linear polarization is oriented at a non-zero angle relative to an antenna axis of the omnidirectional antenna.

21. The antenna feeding method of claim 20, wherein the feedline forms a helix aligned parallel to the antenna axis and having a helical angle similar to the non-zero angle.

22. The antenna feeding method of claim 20, the non-zero angle being ninety degrees.

23. The antenna feeding method of claim 20, wherein the initial polarization is linear and parallel to the antenna axis.

24. The antenna feeding method of claim 20, wherein the initial polarization is circular.

25. The antenna feeding method of claim 18, wherein the final polarization is linear and not parallel to the linear polarization.

26. The antenna feeding method of claim 18, wherein the final polarization is circular.

27. The antenna feed of claim 1, wherein one or both of the first and second polarization converters comprise a plurality of layers.

28. The antenna feeding method of claim 18, wherein one or both of the first and second polarization converters comprise a plurality of layers.

* * * * *